US011897592B1

(12) United States Patent
Sylvia

(10) Patent No.: US 11,897,592 B1
(45) Date of Patent: Feb. 13, 2024

(54) AUTOMATIC PASSIVE VARIABLE PITCH PROPELLER

(71) Applicant: The United States of America as represented by the Secretary of the Navy, Newport, RI (US)

(72) Inventor: Russell M Sylvia, South Dartmouth, MA (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 18/235,968

(22) Filed: Aug. 21, 2023

(51) Int. Cl.
*B63H 3/00* (2006.01)

(52) U.S. Cl.
CPC ..... *B63H 3/008* (2013.01)

(58) Field of Classification Search
CPC .... B63H 3/008; B63H 2011/046; B63H 3/00; F02B 29/02; F02B 7/0224
See application file for complete search history.

(56) References Cited

U.S. PATENT DOCUMENTS 2,682,926 A * 7/1954 Evans ..... B63H 3/008 416/89
3,177,948 A * 4/1965 Reid ..... B63H 3/008 416/500
2013/0294915 A1* 11/2013 Fulmer ..... B63H 3/00 416/151
2015/0086370 A1* 3/2015 Ulgen ..... B63H 3/04 416/155
2020/0156749 A1* 5/2020 Scacchi ..... B63H 3/008

FOREIGN PATENT DOCUMENTS

GB 2233400 A * 1/1991 ..... B63H 3/008

* cited by examiner

*Primary Examiner* — Aaron R Eastman

(74) *Attorney, Agent, or Firm* — James M. Kasischke; Michael P. Stanley; Jeffry C. Severson

(57) ABSTRACT

A propeller pitch adjustment assembly is provided with a base hub operatively connected by blade shafts to propeller blades in which each blade rotates about an axis of each shaft. Each blade shaft is radially disposed about a propeller drive shaft and parallel to a pressure flange of a base hub spring plate. The spring plate counterforces the blade rotation with a lever screw that impacts the plate. An opposing spring transfers a load to the plate. The equilibrium position of the plate is determined by the spring force on the lever and a counteracting force exerted on the lever by a lift force generated by fluid flow over a propeller blade. A capping mechanism can provide a preload to the spring. A force exerted by the lift of the blade on the lever screw results in a blade pitch change.

6 Claims, 9 Drawing Sheets

Small Pitch Angle

AUTOMATIC PASSIVE VARIABLE PITCH PROPELLER

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER APPLICATIONS

None.

BACKGROUND OF THE INVENTION

(1) Field of the Invention

The present invention generally relates to controllable pitch propellers and specifically to a passive variable pitch propeller assembly.

(2) Description of the Related Art

Propellered structures, such as watercraft and wind energy systems, operate in a variety of environmental conditions and a variety of propulsion applications that require variable thrust and speed. Depending on the medium through which a propellered structure moves; a relatively high level of thrust may be required at a low speed (or a rate of advance). Alternatively, a relatively low level of thrust may be required at a high speed. Variable operating conditions can be based on different load states or usage profiles.

Common propeller designs have three or four blades but may have additional blades depending on the requirements for cost, efficiency, size and vibration. The base of each propeller blade mounts at an angle (known as a pitch angle) relative to a radial plane. The radial plane is transverse to an axis of rotation of a propeller shaft on which the propeller is mounted.

Fixed pitch propeller blades are affixed at a pitch angle that provides maximum efficiency at a designated operating condition; however, fixed pitch propellers typically have a reduced efficiency at operating conditions outside of the designated operating condition. Fixed pitch propellers are a compromise of acceleration, fuel consumption, torque and velocity.

Underwater vehicles present unique design challenges for propeller structure. For example, underwater vehicles typically use fixed pitched propellers that are optimized in a comparatively small range of revolutions per minute. Matching a fixed pitch propeller to a motor is also a compromise between low-speed efficiency and high-speed performance. Known variable pitch propellers often employ active controls and typically engage complex, and large mechanisms that increase cost, reduce dependability, and decrease efficiency.

BRIEF SUMMARY OF THE INVENTION

It is therefore a primary object and general purpose of the present invention to provide a variable pitch propeller assembly that performs an automatic operation of propeller pitch control for varying propeller speeds or torques.

To attain the object of the invention, a propeller assembly for automatic passive variable pitch adjustment is provided.

The propeller assembly includes a passively adjustable hub operatively connected to two or more propeller blades in which the propeller blades rotate about a longitudinal axis. Each rotatable propeller blade shaft has a dynamically adjusted pitch relative to rotation speed of the assembly. The assembly can support three to ten rotatable propeller blade shafts.

Each propeller blade shaft is radially disposed about a central axis of the propeller assembly and positioned parallel to the bottom surface of a pressure flange of a spring plate assembly. The spring plate assembly provides a counterforce to the rotation of the propeller blades.

To impact each propeller blade, a lever screw of a hub base projects an integral arm at an acute angle to the propeller blade shaft. Each arm for each lever screw contacts a bottom surface of the pressure flange at an angle relative to the plane of the bottom surface so that movement of the spring plate rotates the propeller blade shaft.

A spring transfers a dynamic load to the pressure flange of the spring plate. A nose cone with a base and an apex connects to the base hub by a central stud secured at the apex of the nose cone and at the base hub. The nut can adjust compression of the spring by tightening and loosening the nut. The base hub has an inner wall and an outer wall with each propeller blade shaft positioned to project through the outer wall and rotatably attached to the inner wall.

The movement of the spring plate coordinates with a blade shaft rotation resulting from movement of the lever screw. The equilibrium position of the spring plate is determined by the mass and a spring force exerted on the lever screw and a counteracting force exerted on the lever screw by a lift force generated by fluid flow over a propeller blade. Changes in the force exerted by the lift of the blade on the lever screw result in a change in the blade pitch.

Another embodiment of the present invention is an automatic passive variable pitch hub assembly with a hub base. An end of the hub base is configured with an inner hub forming an inner wall and an outer wall at a circumference of the base to form guide holes. The guide holes are equidistant from each other about the circumference of the hub base for receiving a proximal end of a propeller blade shaft. Each propeller blade shaft has a lever screw capable of rotating the shaft about the longitudinal axis and a spring plate concentrically aligned with the hub base. A pressure flange is proximal to the hub base and a spring interface is distal from the hub base.

In operation, the pressure flange contacts the lever screw at an angle so that displacement of the spring plate rotates the propeller blade shaft. A spring is concentric relative to the base with the diameter of the end proximal to the spring plate in contact with an interface of the spring plate and the distal diameter of the spring in contact with a capping mechanism.

The capping mechanism is adjustable to provide a preload force to the spring. The capping mechanism includes a nose cone with a base and an apex. A wall of the nose cone covers the spring plate and spring with the base of the nose cone shaped to seat with the hub base.

The nose cone connects to the base by a stud or similar mechanism. The proximal end of the stud passes through the center of the nose cone and the spring plate attaches to the propeller shaft. The nose cone is secured by a fastener or nut between the stud and the spring. The base hub is attached to the motor/propeller shaft with a set screw in the side of the base hub that contacts the side of the motor/propeller shaft.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

The passive variable pitch propeller assembly of the present invention automatically controls the pitch of employed blades relative to the speed of propeller rotation (in revolutions per minute—RPM) with the result of optimizing propulsion performance over a motor speed range.

A variable pitch propeller of the assembly increases propeller pitch at increasing speeds and reduces propeller pitch at decreasing speeds. To be explained further below, the variable pitch propeller provides a mechanically simple assembly that minimizes cost and weight, as well as delivering an active pitch.

Figure 1:
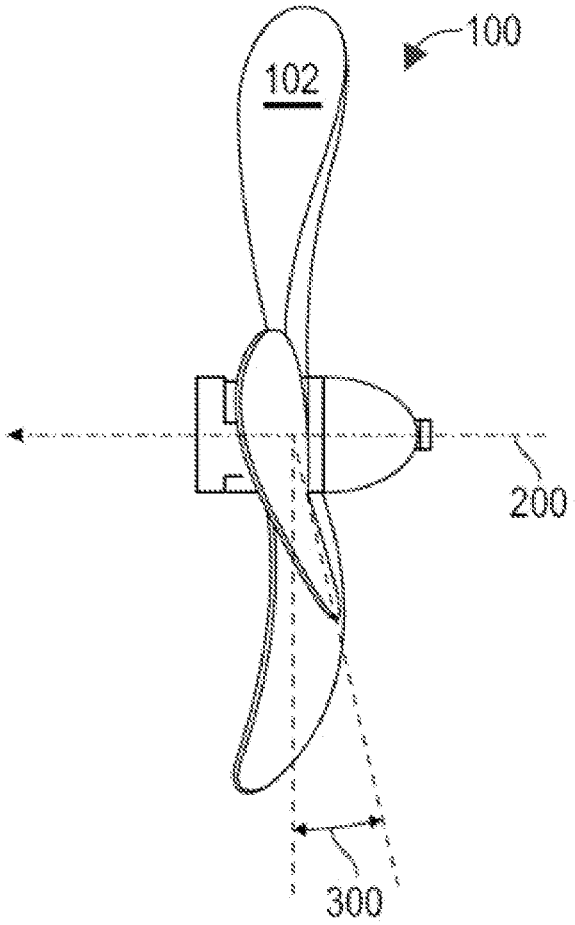
FIG. 1 depicts a side view of an automatic passive variable pitch propeller of the present invention operating at a small pitch angle.
Figure 2:
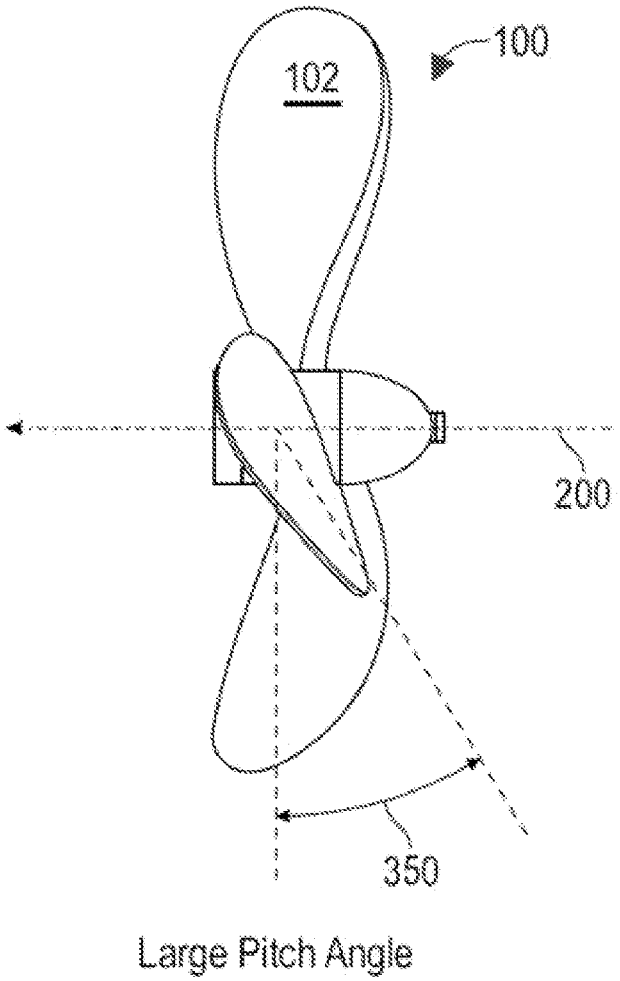
FIG. 2 depicts a side view of the variable pitch propeller of FIG. 1 operating at a large pitch angle.

In FIG. 1 and FIG. 2, an automatic passive variable pitch propeller assembly 100 of the present invention is shown operating at a low RPM and a high RPM, respectively. In operation, the variable pitch propeller assembly 100 attaches to a shaft (not shown) that spins about a rotation axis 200 at the low RPM to dynamically create a relatively small pitch angle 300 for each blade 102. Each revolution of the propeller moves a vehicle forward at a comparatively small distance.

This movement creates torque to overcome initial drag; thereby, producing an efficient performance at relatively slow vehicle speeds. At a high RPM, the variable pitch propeller assembly 100, when spinning about a shaft (not shown) along the rotation axis 200, dynamically creates a relatively large pitch angle 350 for each blade 102 with each revolution moving the vehicle at a larger distance forward.

This operation moves the vehicle quickly through the water for efficient performance at high vehicle speeds. Further efficiency can be achieved by tuning the system to create a high pitch at a lower speed than the maximum revolutions-per-minute; thereby, creating an efficient cruise speed to optimize endurance. The automatic passive variable pitch propeller assembly 100 also passively adjusts to prevent blade stall at a slow speed and to prevent over-speed at high-speed operations.

Figure 3:
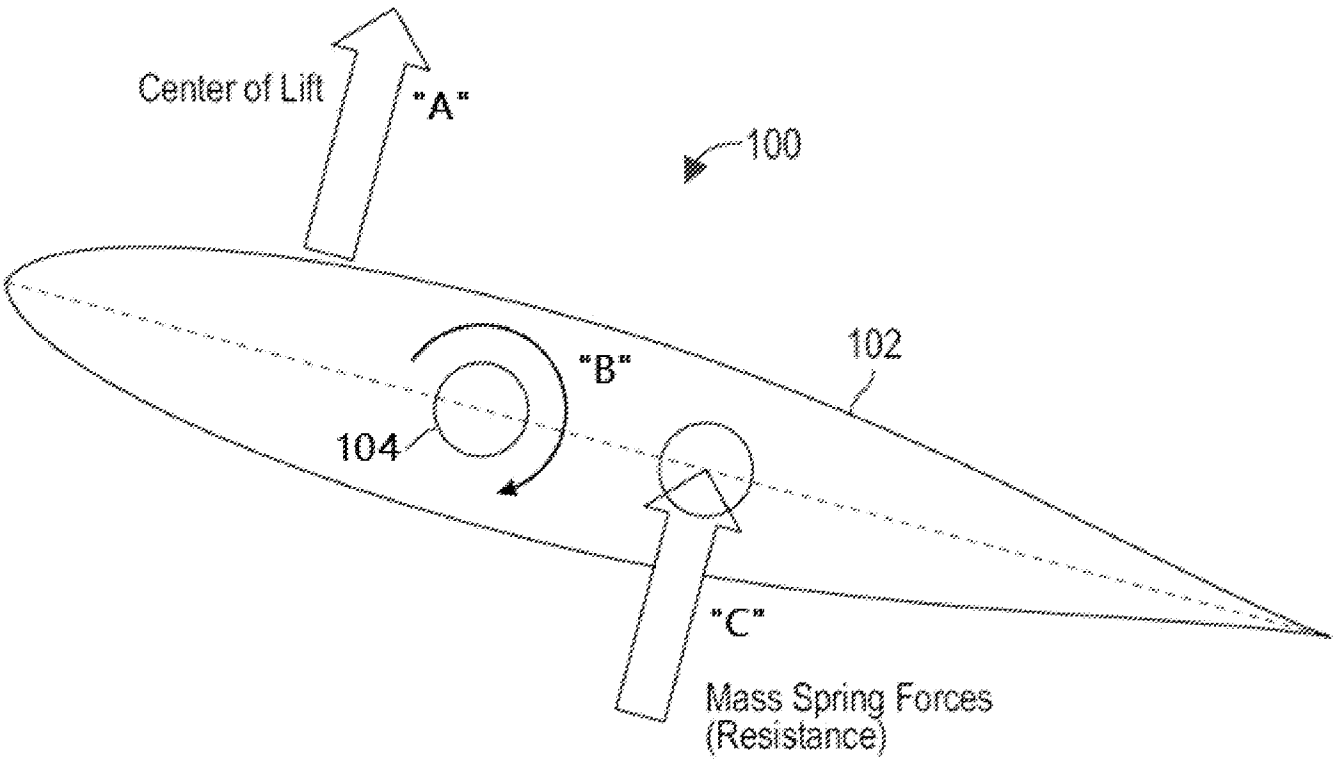
FIG. 3 depicts a schematic and side view of a foil of the variable pitch propeller of the present invention with related forces and points of action for movement about a pivot point.

Referring now to FIG. 3, the automatic passive variable pitch propeller assembly 100 incorporates the propeller blade 102 with an axis of rotation at a pivot point 104 adjacent to a hydrodynamic center of lift, shown by direction "A". The blade pitch angle adjustment, a rotation (in direction "B") to increase/decrease pitch is achieved by using the hydrodynamic center of lift and centrifugal forces countered by mass spring forces (in direction "C") on the blade 102. The mass spring forces are provided by a passive pitch adjustment mechanism, shown in FIGS. 5-9.

Figure 4:
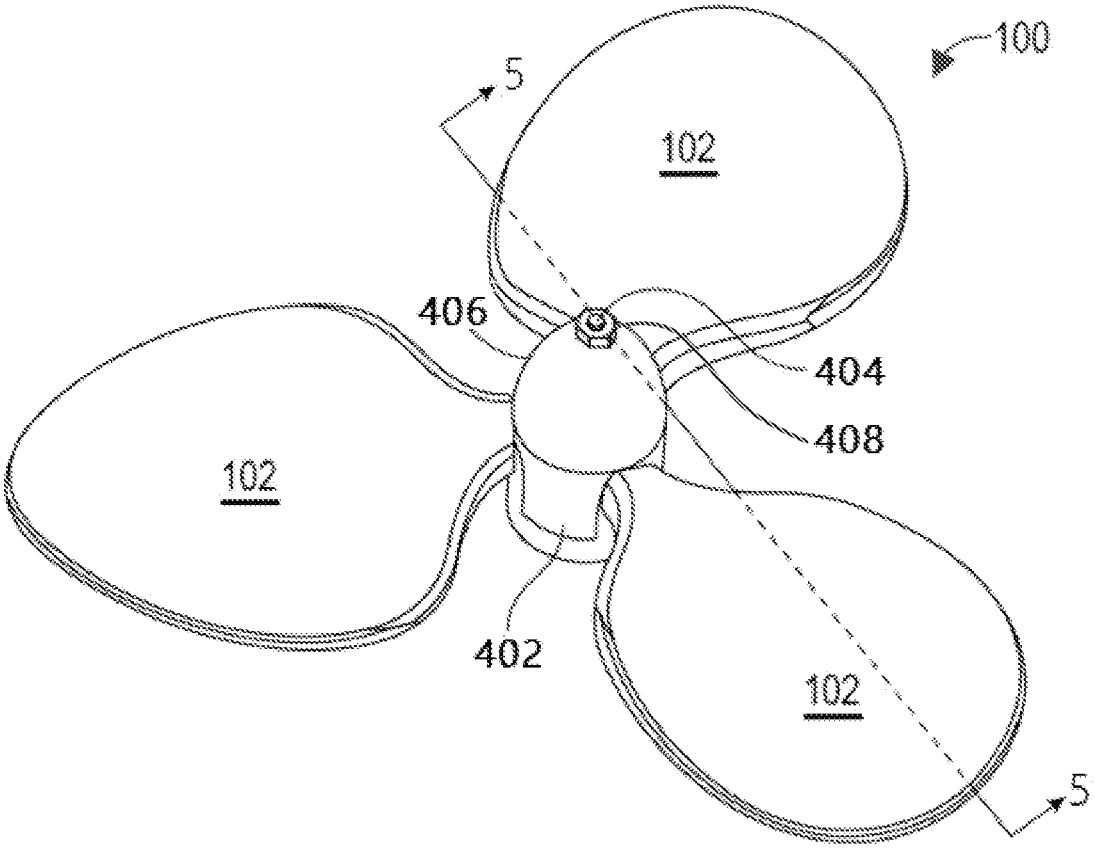
FIG. 4 depicts a top view of the variable pitch propeller.

FIG. 4 depicts a top view of the variable pitch propeller assembly 100 of the present invention. The variable pitch propeller assembly 100 includes the propeller blades 102 operatively connected to a base hub 402 which is attached to the motor/propeller shaft (not shown) by a set screw. The propeller blades 102 connect to the base hub 402. A central stud 404 projects through a nose cone 406 affixed by a nut 408. The central stud and nut retain the nose cone, spring and spring plate. The central stud is attached to the end of the propeller/motor shaft.

Figure 9:
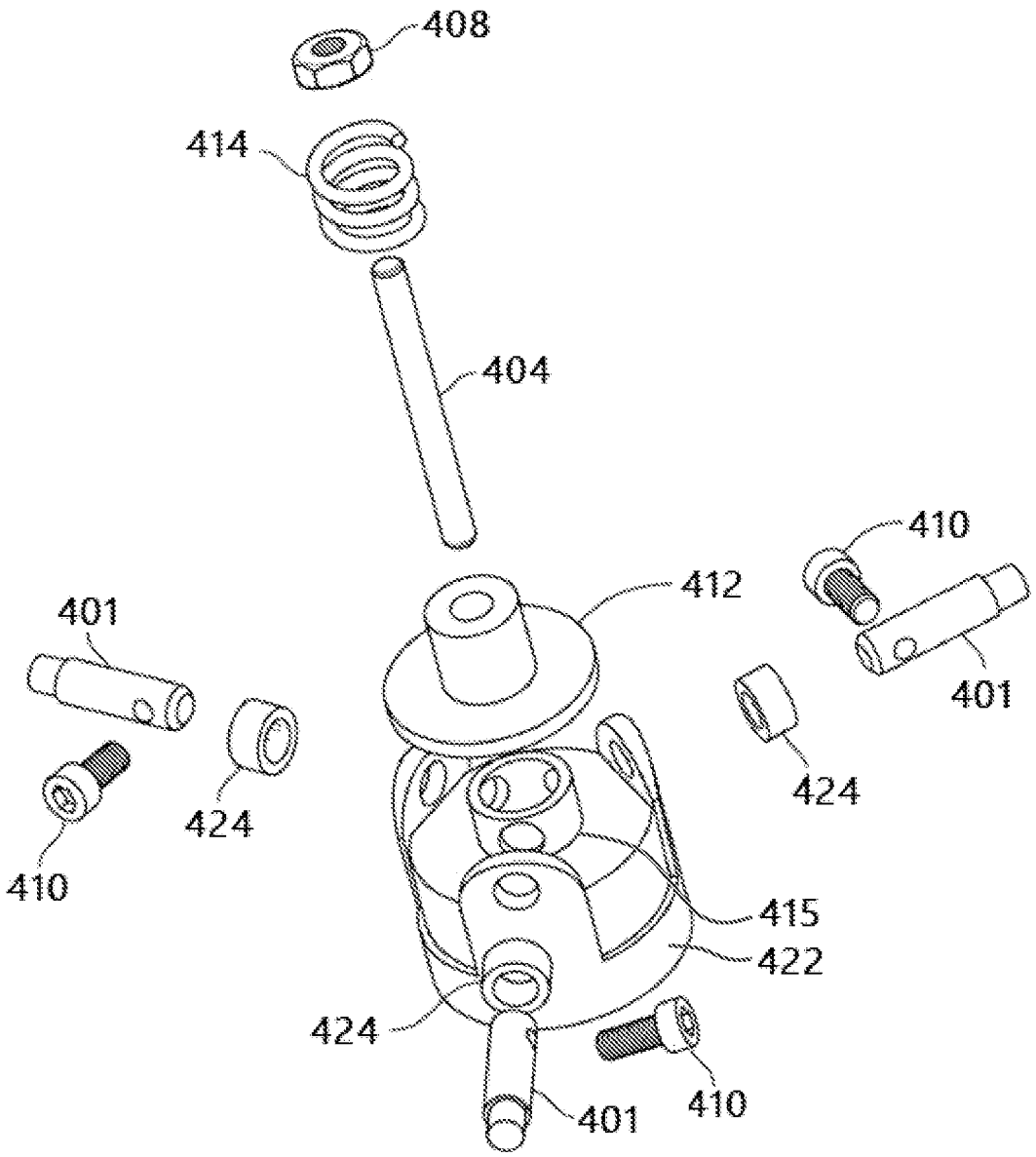
FIG. 9 depicts an exploded view of the passive pitch adjustment mechanism of FIG. 7.

The base hub 402 is configured to be affixed to a propeller drive shaft (not shown). To assemble the propeller blade assembly to the base hub 402; the spacer 424 of FIG. 9 is placed in-line and between the radial holes of the inner wall 415 and the outer wall 420 of the base hub. The propeller blade shaft 401 is inserted into the radial hole in the outer wall 420 of the base hub, then slid through the spacer 424 and into the hole in the inner wall 415 of the base hub. The spacer 424 is positioned closest to the outer wall 420 and then the lever screw 410 is threaded into the propeller blade shaft 401.

Figure 5:
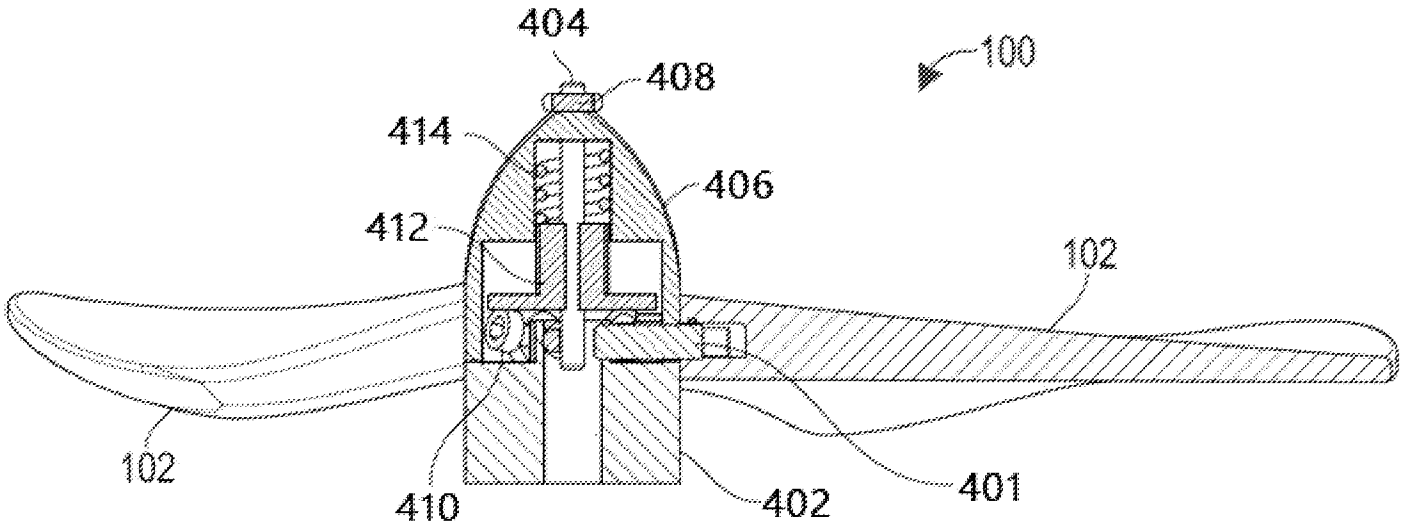
FIG. 5 depicts a cross-section view of the variable pitch propeller of FIG. 4 with the view taken along reference lines 5-5 of FIG. 4.

FIG. 5 depicts a cross-section of the automatic passive variable pitch propeller assembly 100 of FIG. 4. The cross-section depicts the attachment of the propeller blade 102 with a propeller blade shaft 401 connected to the base hub 402 with a spacer positioned between the inner base hub wall and the outer base hub wall.

A lever screw 410 connects to the propeller blade shaft 401 to form a projection. The lever screw 410 operationally contacts with a spring plate 412. The spring plate 412 is in operable contact with a spring 414 which provides a spring force that counterbalances the rotational force of the lever screw 410 imparted by the lift force generated by the propeller blade 102.

The higher the rotation; the greater the rotational force by the lever screw 410 which results in compression of the spring 414 and a rotation of the propeller blade 102 to increase pitch. With a slower rotation; the spring force on the spring plate 412 provides a force that rotates the lever screw 410 to a new equilibrium between the lift force and the mass spring force to result in a smaller pitch at low speed.

Figure 6:
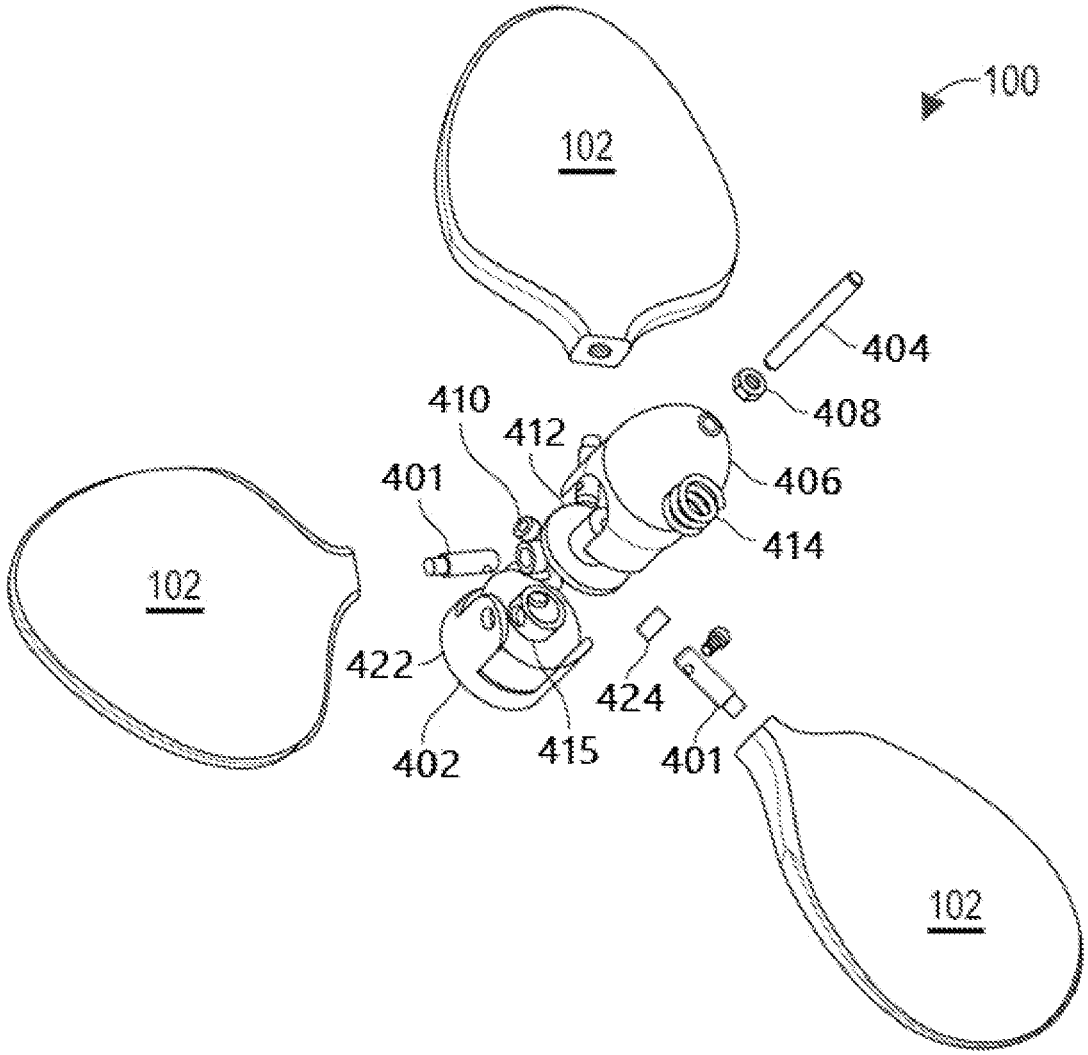
FIG. 6 depicts an exploded view of the variable pitch propeller of FIG. 4.

FIG. 6 depicts three propeller blades 102 rotatably connected to the base hub 402 by three propeller blade shafts 401. The base hub 402 has a first or top portion for receiving and attaching the propeller blades 102. The base hub 402 includes an inner hub wall 415 configured to receive a proximal end of the propeller of the propeller blade shaft 401 and allows rotation of the propeller blade shaft during use.

An outer hub wall 422 receives the propeller blade or pivot shaft 401 through an opening. The opening can be a slot in or a hole through the outer hub wall 422. When assembled, the propeller blade shafts 401 pass through the outer base hub wall 422 and then spacers 424 to seat within the inner hub wall 415.

Each of the propeller blade shafts 401 connect to a lever screw 410 in which each lever screw is positioned at an acute angle to the longitudinal axis of the corresponding propeller blade shaft. When assembled, a head of each lever screw 410 can be in contact with a bottom surface of the spring plate 412. The top surface of the spring plate 412 is in operational contact with the spring 414. The assembly is capped by the nose cone 406 and is secured by the stud 404 and the nut 408.

Figure 7:
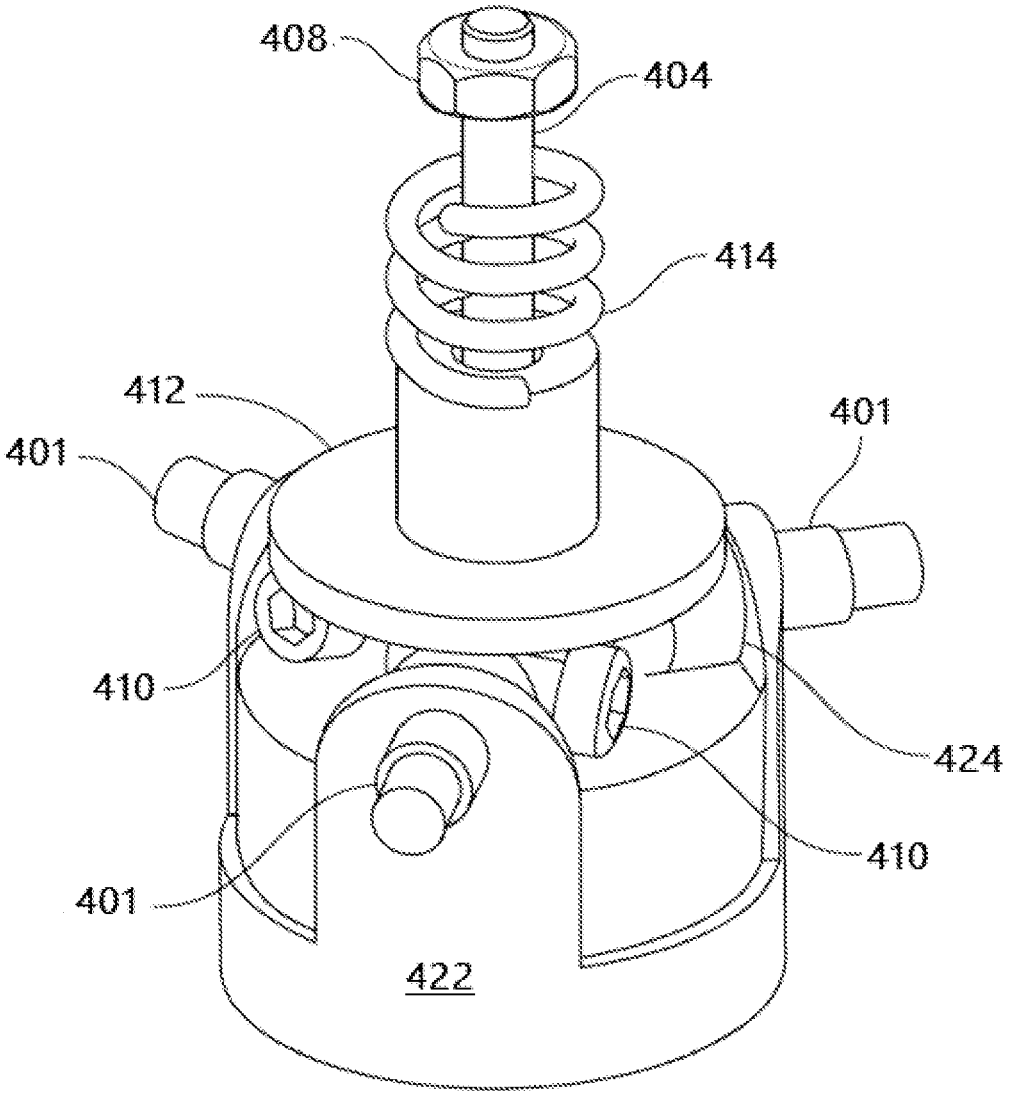
FIG. 7 depicts a perspective view of a passive pitch adjustment mechanism of the variable pitch propeller of FIG. 4.
Figure 8:
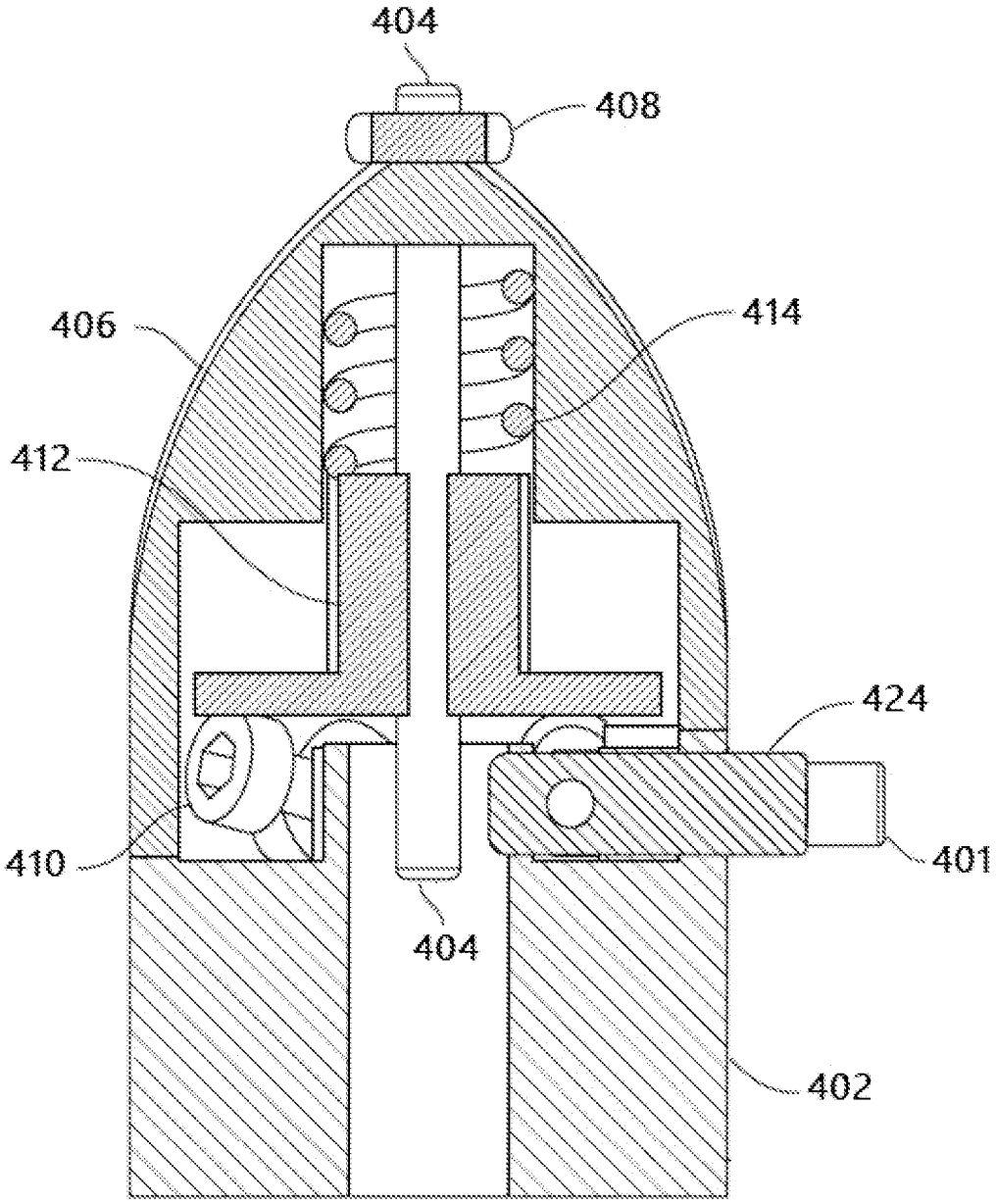
FIG. 8 depicts a cross-section view of a base hub of the variable pitch propeller of FIG. 7.

Referring now to FIG. 7, an exemplary passive pitch adjustment mechanism illustrates connection of a linkage, mass, spring and nut screw mechanism. In FIG. 8, a cross section view of the base hub 402 illustrates an exemplary passive pitch adjustment mechanism operatively mounted within the base hub and the nose cone 406.

The nut 408, or functional alternative, secures the nose cone 406 and provides for the adjustment of preload on the spring 414. The preload sets a resistance to the force moments imparted by an arm of the lever screw 410 prior to operation. The length of the arm of the lever screw 410 projecting from the propeller blade shaft or pivot shaft 401 can vary to provide variable lever length. Optionally, the operational length of the arm of the lever screw 410 can be adjusted by depth of the arm when screwed or embedded into the propeller or pivot shaft 401 (the deeper the insertion of lever screw arm, the shorter the operational length of the arm of the lever screw).

The mass and spring system counteracts the lift forces to create a force balance across a range of operation as a function of Revolutions per Minute (RPM). Different sized springs with different force deflections optimize the range of performance as a course adjustment, while the nut 408 can be used to increase or decrease spring tension by tightening or loosening the nut.

Additionally referring to FIG. 9, the nut 408 can be screwed into the end of the central stud 404 or the base hub 402. The base hub 402 attaches to the outside diameter of propeller blade shaft 401. The propeller blade shaft or pivot shaft 401 is fixed to the hub base inner wall 415 and passes through the hub base outer wall 422. The lever screw 410 is attached at an acute angle to the propeller pivot shaft 401. When fully assembled, the spring plate 412 contacts the head of each lever screw 410. The spring 414 is positioned between the spring plate 412 and the apex of the nose cone 412 with the mechanism held in place by the nut 408.

During operation, external forces act on the propeller blade 102 and rotate the blade about the propeller or pivot shaft 401. The lever screw 410 attached to the propeller or pivot shaft 401 presses against the spring plate 412. The spring plate 412 compresses the spring 414; thereby causing resistance to balance the forces.

With an adjustable propeller assembly, the propeller performance can be pre-set and tuned to an operational need prior to launch. The spring load can be adjusted to a lighter load to maximize endurance or adjusted to a heavier load to delay high speed. The angle can also be set or jammed to simulate a fixed pitch.

The Total Force (computed as Lift Force+Thrust Force—Centrifugal Farce) can be modeled using Equation (1):

$$\frac{1}{2}\rho V^2 A\,Cl+\rho V^2 D^2-m\left(\frac{v^2}{r}\right) \tag{1}$$

where A=Area (inches 2), Cl=Coefficient of lift, D=Diameter (inches), m=Mass (pounds), r=Radius (inches), V=Velocity (feet per second), and ρ=Density (pounds per cubic foot).

The main advantage of the present invention is that the passive variable pitch propeller assembly can optimize propeller performance over a range of speed. The passive variable pitch propeller assembly has a low part count and utilizes hydrodynamic and centrifugal forces to adjust a propeller angle. Changing the vehicle motor RPM changes the propeller pitch angle to create efficient propeller performance for a range of vehicle speeds.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An automatic passive variable pitch propeller assembly connectable to a propeller drive shaft, said assembly comprising:

a base hub with a pressure flange and a spring plate, said base hub connected to the propeller drive shaft with a set screw in the side of said base hub that contacts a side of the propeller drive shaft;

at least two blade shafts radially extending from the propeller drive shaft with each said blade shaft extending into said base hub adjacent to said pressure flange and opposite to a top portion of said spring plate;

at least two propeller blades with each of said at least two propeller blade shafts rotatable about each of said blade shafts;

a spring capable of transmitting a dynamic load to said spring plate; and a lever screw for each of said propeller blades with said lever screw projecting at an acute angle with respect to each said blade shaft wherein said lever screw is capable of contacting said pressure flange so that movement of said spring plate along a central axis aligned with the propeller drive shaft is capable of rotating said blade shaft.

2. The automatic passive variable pitch propeller assembly in accordance with claim 1 wherein each of said blade shafts is mechanically connected to said propeller blade with each of said blade shafts having a dynamically adjusted pitch relative to a rotation speed of the propeller drive shaft.

3. The automatic passive variable pitch propeller assembly in accordance with claim 2, said propeller assembly further comprising a nose cone and an apex with said nose cone retained by a central stud collinear with the central axis with said central stud threaded into an end of the propeller drive shaft.

4. The automatic passive variable pitch propeller assembly in accordance with claim 3, wherein said stud and said nut are capable of adjusting spring compression by at least one of tightening and loosening said nut on said stud.

5. The automatic passive variable pitch propeller assembly in accordance with claim 4 wherein said base hub has an inner wall and an outer wall; and wherein each of said rotatable propeller blade shafts is positioned to project through said outer wall and rotatably attach to said inner wall.

6. The automatic passive variable pitch propeller assembly in accordance with claim 5 wherein movement of said spring plate along the central axis coordinates with rotation of said blade shaft by movement of said lever screw;

wherein an equilibrium of a position of said spring plate is determinable by the mass and spring force exerted on said lever screw and a counteracting force exerted on said lever screw by a lift force generated by fluid flow over each of said propeller blades; and wherein changes in the force exerted by the lift force of said propeller blade on said lever screw results in a change in pitch of said propeller blade.

* * * * *